US005555581A

United States Patent [19]

Woods

[11] Patent Number: 5,555,581

[45] Date of Patent: Sep. 17, 1996

[54] BED BRIDGE AND MATTRESS COVER

[76] Inventor: Claudia Woods, 1459 St. Louis Dr., Honolulu, Hi. 96816

[21] Appl. No.: 519,084

[22] Filed: Aug. 24, 1995

[51] Int. Cl.[6] ..... A47G 9/00; A47C 21/00

[52] U.S. Cl. ..... 5/502; 5/513; 5/658

[58] Field of Search ..... 5/502, 658, 513, 5/499, 500, 8, 81.1

[56] References Cited

U.S. PATENT DOCUMENTS

| | | | |
|---|---|---|---|
| 2,501,267 | 3/1950 | Erikson | 5/499 |
| 2,638,608 | 5/1953 | Garrigus, Sr. | 5/47 |
| 3,157,889 | 11/1964 | Chanko | 5/513 |
| 4,012,799 | 3/1977 | Rutherford | 5/81.1 |
| 4,231,127 | 11/1980 | Bendell | 5/465 |
| 4,648,141 | 3/1987 | Mansouris et al. | 5/8 |
| 5,036,557 | 8/1991 | Fales | 5/81.1 |

*Primary Examiner*—Alexander Grosz
*Attorney, Agent, or Firm*—Michael I. Kroll

[57] ABSTRACT

A bed bridge (10) for converting a pair of beds (12) and (14) into a larger sized bed comprising a platform member (16) and an elongated protrusion (18) projecting downwardly from the center of the platform member (16). When the platform member (16) is placed upon juxtaposed portions of the top surfaces (20) and (22) of two adjacent mattresses (24) and (26) of the beds (12) and (14), the elongated protrusion (18) will extend down between the sides (28) and (30) of the two adjacent mattresses (24) and (26). When the two adjacent mattresses (24) and (26) are pushed together, the elongated protrusion (18) will then cause the platform member (16) to properly position itself on the juxtaposed portions of the top surfaces (20) and (22) of the two adjacent mattresses (24) and (26).

11 Claims, 2 Drawing Sheets

Fig. 3
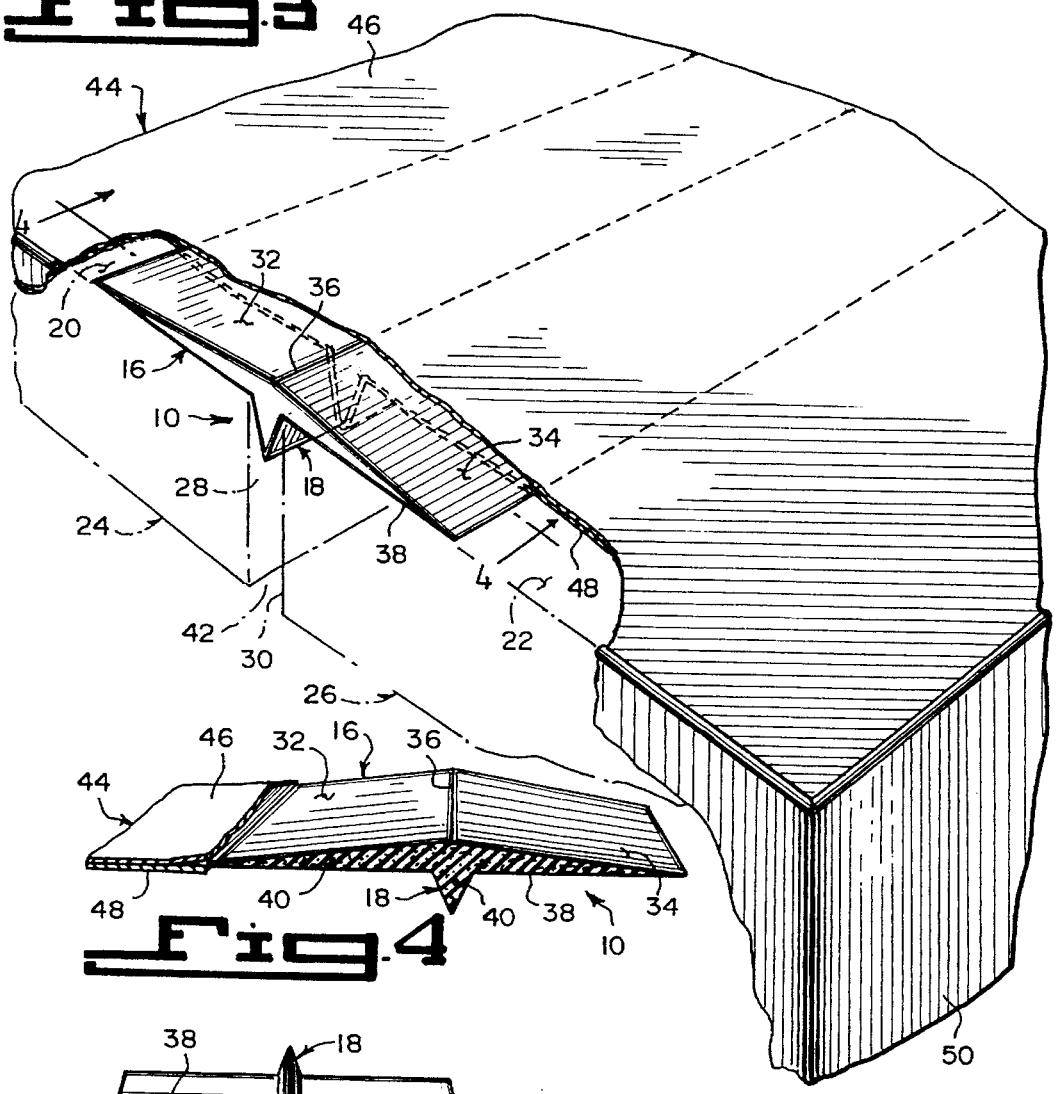
Fig. 4
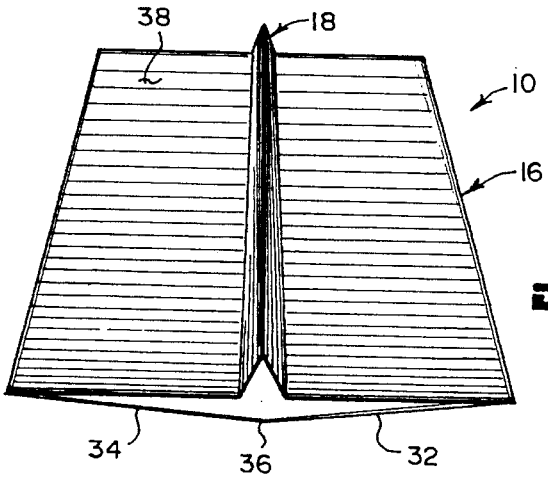
Fig. 5

BED BRIDGE AND MATTRESS COVER

BACKGROUND OF THE INVENTION

1. Field of the Invention

The instant invention relates generally to bedding equipment and more specifically it relates to a bed bridge.

2. Description of the Prior Art

Numerous bedding equipment have been provided in prior art. For example, U.S. Pat. Nos. 2,638,608 to Garrigus, Sr.; 3,157,889 to Chanko, 4,231,127 to Bendell and 4,648,141 to Mansouris et al. all are illustrative of such prior art. While these units may be suitable for the particular purpose to which they address, they would not be as suitable for the purposes of the present invention as heretofore described.

GARRIGUS, SR., ROBERT O.

PAD ATTACHMENT FOR BED COUCHES

U.S. Pat. No. 2,638,608

In a pad attachment for a bed couch, a foundation cover is shaped to conformably embrace a bed couch. A pad conformably shaped to fit the cover is superimposed upon the cover and is attached to the cover in at least two opposed regions spaced from the bounding edges of the cover to form a free marginal portion of the pad which may be lifted to give access to the space between such portion and the cover and to tuck into the space the marginal portions of a bed sheet when covering the pad attachment.

CHANKO, MORTIMER L.

CONVERSION OF TWIN BEDS TO A DOUBLE BED

U.S. Pat. No. 3,157,889

A device for transforming a pair of twin beds into one bed comprises a strip of flexible foamed material of a width to bridge the space between, and overlap the adjacent marginal top surfaces of mattresses of twin beds in a closely adjoining substantially abutting relation. A bottom, generally rectangular, central, dependent rib on the strip is engageable between opposed adjoining vertical sides of the mattresses for positioning the strip as a bridge across a space between the mattresses. The rib is relatively thick and frictionally engageable between the vertical sides of the mattresses to hold the strip in a flat engagement with the adjacent marginal top surfaces of the mattresses.

BENDELL, ABRAHAM D.

FOLDABLE CUSHIONING AND SUPPORT

U.S. Pat. No. 4,231,127

At least a pair of separate cushioning members are interconnected by an overlying face of a cover and disposed side by side at the side regions. Border strips are secured each along one of their edges to a corresponding inner skin overlying one main face of a cushioning member. At the opposite main faces corresponding cover sheets are secured at the other edges of the border strips. The interconnecting cover overlies the inner skins and is secured along its periphery to them and to the first mentioned edges of the border strips. The method includes joining two border strips each to one edge of an inner skin, drawing them round a cushioning member and securing a cover sheet to each, over laying an additional cover sheet over both skins and securing it peripherally to them and the adjacent edges of the border strips forming two pouches one to both sides of a hingeable fold zone of the overlaying cover sheet. A mattress is provided, foldable for transport on stairways and access to a support with a corresponding hingeable baseboard.

MANSOURIS, MANSOUR N.

MANSOURI, MANSOUD N.

IMANI, KAMBIZ

POWER OPERATED SEPARABLE BEDS AND PLATFORM

U.S. Pat. No. 4,648,141

A composite bedding unit comprised of adjoining single bed units adapted to be juxtaposed in the form of double bedding and separable along a median line dividing the sleeping areas of two retiring individuals having distinct sleeping requirements when lying together. The two bed units are carried by a platform to which the bed units are mechanized to be separated from the median line for single bed conditioning. Provision is made for safety and for ease of assembly and disassembly within a minimum of space.

SUMMARY OF THE INVENTION

A primary object of the present invention is to provide a bed bridge that will overcome the shortcomings of the prior art devices.

Another object is to provide a bed bridge that can be placed upon two adjacent mattresses of a pair of beds, so that the pair of beds can be quickly converted into a larger single bed.

An additional object is to provide a bed bridge that can be built into a mattress cover, so that the mattress cover can be properly installed over the two adjacent mattresses of the pair of beds.

A further object is to provide a bed bridge that is simple and easy to use.

A still further object is to provide a bed bridge that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a perspective view of the instant invention built into a mattress cover that is broken away, and the abutting mattresses shown in phantom.

FIG. 4 is a cross sectional perspective view taken along line 4—4 in FIG. 3.

FIG. 5 is an inverted perspective view of the instant invention per se.

Similar reference characters denote corresponding features consistently throughout the attached drawings.

DETAILED DESCRIPTION OF THE PREFERRED EMBODIMENTS

Figure 1:
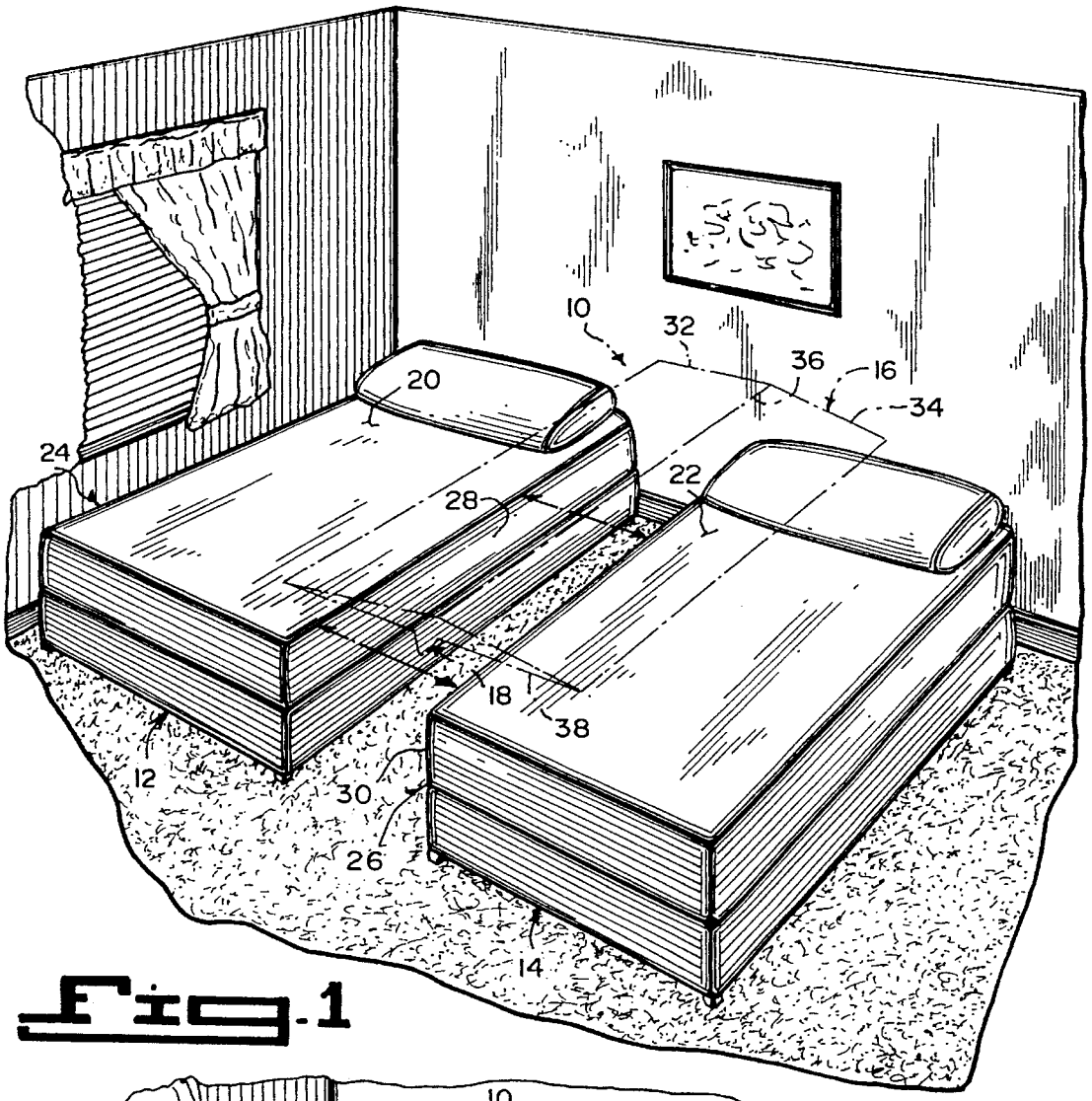
FIG. 1 is a perspective view showing the instant invention in phantom, ready to be placed upon the mattresses of a pair of beds, which are to be abutted in a side by side relationship.
Figure 2:
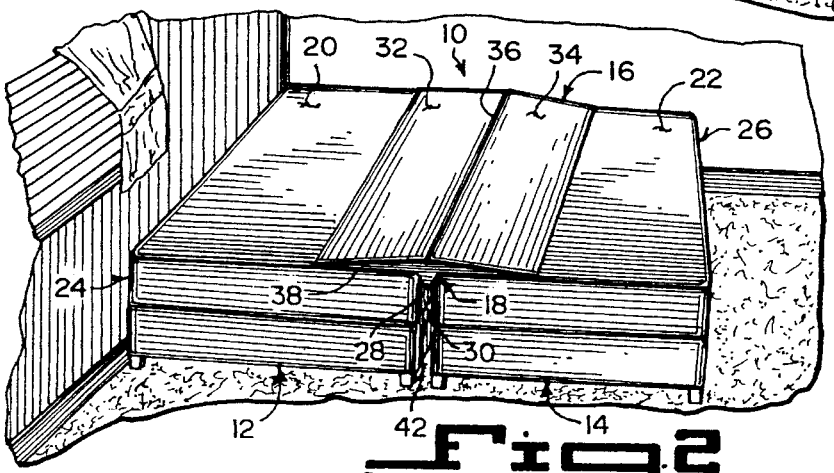
FIG. 2 is a perspective view showing the instant invention placed upon the mattresses of the beds, which are abutted in the side by side relationship.

Turning now descriptively to the drawings, in which similar reference characters denote similar elements throughout the several views, FIGS. 1 through 5 illustrate a bed bridge 10 for converting a pair of beds 12 and 14 into a larger single bed, comprising a platform member 16 and an elongated protrusion 18 projecting downwardly from the center of the platform member 16. When the platform member 16 is placed upon juxtaposed portions of the top surfaces 20 and 22 of two adjacent mattresses 24 and 26 of the beds 12 and 14, the elongated protrusion 18 will extend down between the sides of the two adjacent mattresses 24 and 26. When the two adjacent mattresses 24 and 26 are pushed together, the elongated protrusion 18 will then cause the platform member 16 to properly position itself on the top surfaces 20 and 22 of the two adjacent mattresses 24 and 26.

The platform member 16 includes a top surface divided into two equal and gradual sloping segments 32 and 34 with a longitudinal center ridge 36 therealong. A flat bottom surface 38 is provided, which forms in cross section a gradual triangle, so as to provide maximum strength at the center ridge 36 above the elongated protrusion 18. The elongated protrusion 18 is an equilateral triangle in cross section.

The platform member 16 is fabricated out of a strong durable material 40. The strong durable material 40 is foam rubber. The elongated protrusion 18 is fabricated out of the strong durable material 40. The strong durable material is also foam rubber. The platform member 16 and the elongated protrusion 18 are integral and fabricated out of the strong durable material 40, which is the foam rubber.

The platform member 16 is of the same length as the length of each mattress 24 and 26 of each bed 12 and 14, so as to completely cover a slight space 42 between the two adjacent mattresses 24 and 26. The elongated protrusion 18 is of the same length as the length of the platform member 16, so as to completely fit into the slight space 42 between the two adjacent mattresses 24 and 26.

FIGS. 3 and 4 show a mattress cover 44 having the platform member 16 and the elongated protrusion 18 built therein. The mattress cover 44 is sized to be properly installed over the two adjacent mattresses 24 and 26 of the pair of beds 12 and 14. The mattress cover 44 consists of a pair of top sheets 46 and 48 to centrally enclose the platform member 16 and the elongated protrusion 18 therebetween. A skirt 50 extends about the perimeter of the pair of top sheets 46 and 48, so as to fit about the exposed sides of the two adjacent mattresses 24 and 26 of the pair of beds 12 and 14.

Typically, the pair of beds 12 and 14 are two twin beds. When the two twin beds are placed in a side by side relationship and the bed bridge 10 installed therebetween, the two twin beds are then converted into a full size double bed. Other types of beds can also be used in conjunction with the bed bridge 10 to be converted into one larger single bed.

OPERATION OF THE INVENTION

To use the bed bridge 10, the following steps should be taken:

1. Place the flat bottom surface 38 of the platform member 16 on both the top surface 20 of the mattress 24 of the first bed 12 and the top surface 22 of the mattress 26 of the second bed 14.
2. Push the beds 12 and 14 together in a side by side relationship, so that the elongated protrusion 18 will fit between the sides 28 and 30 of the mattresses 24 and 26 in the slight space 42.
3. When using the mattress cover 44 place the second top sheet 48 onto the top surface 20 of the mattress 24 of the first bed 12 and the top surface 22 of the mattress 26 of the second bed 14.
4. Push the beds 12 and 14 together in a side by side relationship, so that the elongated protrusion 18 under the second top sheet 48 will fit between the sides 28 and 30 of the mattresses 24 and 26 in the slight space 42.
5. Place the skirt 50 of the mattress cover 44 about the mattresses 24 and 26.

LIST OF REFERENCE NUMBERS

10 bed bridge
12 first bed
14 second bed
16 platform member of 10
18 elongated protrusion of 10
20 top surface of 24
22 top surface of 26
24 mattress of 12
26 mattress of 14
28 side of 24
30 side of 26
32 first gradual top surface sloping segment of 16
34 second gradual top surface sloping segment of 16
36 center ridge between 32 and 34
38 flat bottom surface of 16
40 strong durable material (foam rubber) for 16 and 18
42 slight space between 24 and 26
44 mattress cover
46 first top sheet of 44
48 second top sheet of 44
50 skirt of 44

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A bed bridge and mattress cover for converting a pair of beds into a larger single bed comprising:

a) a platform member; and b) an elongated protrusion projecting downwardly from the center of said platform member, whereby when said platform member is placed upon juxtaposed portions of the top surfaces of two adjacent mattresses of the beds, said elongated protrusion will extend down between the sides of the two adjacent mattresses, so that when the two adjacent mattresses are pushed together, said elongated protrusion will then cause said platform member to properly position itself on the top surfaces of the two adjacent mattresses, said mattress cover including:

c) pair of top sheets centrally enclosing said platform member and said elongated protrusion therebetween; and d) a skirt to extend about the perimeter of said pair of top sheets, so as to fit about the exposed sides of the two adjacent mattresses of the pair of beds.

2. A bed bridge and mattress cover, as recited in claim 1, wherein said platform member includes:

a) a top surface divided into two equal and gradual sloping segments with a longitudinal center ridge therealong; and b) a flat bottom surface, which forms in cross section a gradual triangle, so as to provide maximum strength at said center ridge above said elongated protrusion.

3. A bed bridge and mattress cover, as recited in claim 1, wherein said elongated protrusion is an equilateral triangle in cross section.

4. A bed bridge and mattress cover, as recited in claim 1, wherein said platform member is fabricated out of a strong durable material.

5. A bed bridge and mattress cover, as recited in claim 4, wherein the strong durable material is foam rubber.

6. A bed bridge and mattress cover, as recited in claim 1, wherein said elongated protrusion is fabricated out of a strong durable material.

7. A bed bridge and mattress cover, as recited in claim 6, wherein said strong durable material is foam rubber.

8. A bed bridge and mattress cover, as recited in claim 1, wherein said platform member and said elongated protrusion are integral and fabricated out of a strong durable material.

9. A bed bridge and mattress cover, as recited in claim 8, wherein said strong durable material is foam rubber.

10. A bed bridge and mattress cover, as recited in claim 1, wherein said platform member is of the same length as the length of each mattress of each bed, so as to completely cover a slight space between the two adjacent mattresses.

11. A bed bridge and mattress cover, as recited in claim 1, wherein said elongated protrusion is of the same length as the length of said platform member, so as to completely fit into the slight space between the two adjacent mattresses.

* * * * *